United States Patent [19]

Osborne

[11] 4,181,840

[45] Jan. 1, 1980

[54] ANTICIPATIVE TURBINE CONTROL

[75] Inventor: Robert L. Osborne, Wallingford, Pa.

[73] Assignee: Westinghouse Electric Corp., Pittsburgh, Pa.

[21] Appl. No.: 549,568

[22] Filed: Feb. 13, 1975

[51] Int. Cl.[2] ..... F01D 19/02

[52] U.S. Cl. ..... 290/40 R; 60/646; 415/17

[58] Field of Search ..... 290/40, 52; 60/645, 60/646; 415/15, 17

[56] References Cited

U.S. PATENT DOCUMENTS

| | | | |
|---|---|---|---|
| 3,446,224 | 5/1969 | Zwicky, Jr. | 415/17 |
| 3,928,972 | 12/1975 | Osborne | 60/646 |
| 3,934,128 | 1/1976 | Uram | 290/40 R X |
| 4,053,746 | 10/1977 | Braytenbah et al. | 290/40 R X |

*Primary Examiner*—Gene Z. Rubinson
*Assistant Examiner*—W. E. Duncanson, Jr.
*Attorney, Agent, or Firm*—E. F. Possessky

[57] ABSTRACT

Present speed and present steam temperature are utilized in accordance with a mathematical model to evaluate present steam to turbine heat transfer and turbine heat propagation quantities, and present turbine rotor and casing surface and volume average temperatures. The model is corrected for inaccuracy based on comparison of calculated rotor to casing differential expansion with measured values, and is exercised once more with anticipated speed and steam temperature quantities to develop anticipated rotor to casing differential expansion and anticipated rotor stress. These quantities are compared with various predetermined limits to determine whether the present and anticipated speed and acceleration are within allowable limits.

49 Claims, 15 Drawing Figures

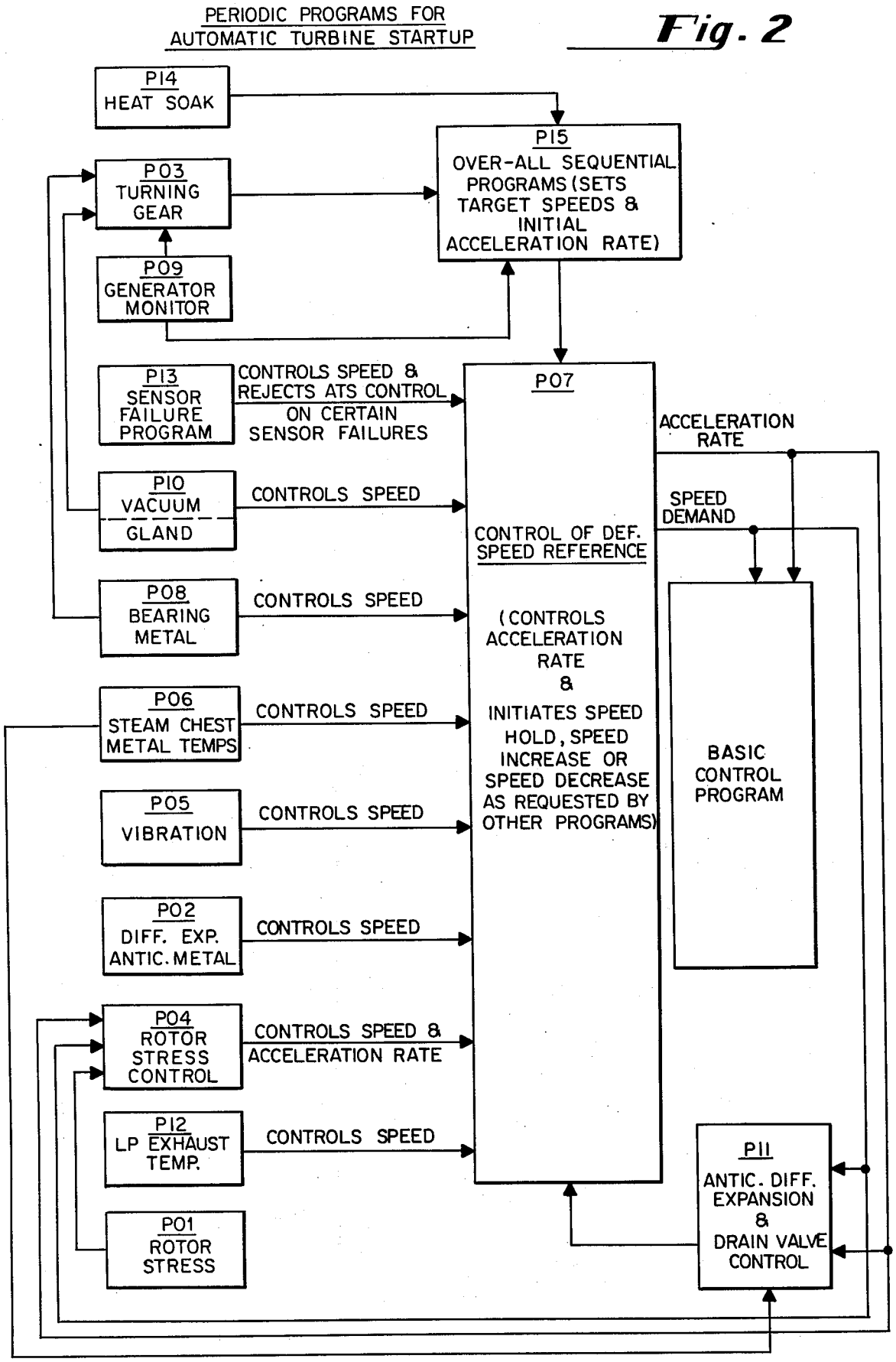
PERIODIC PROGRAMS FOR AUTOMATIC TURBINE STARTUP
Fig. 2
P14 HEAT SOAK
P15 OVER-ALL SEQUENTIAL PROGRAMS (SETS TARGET SPEEDS & INITIAL ACCELERATION RATE)
P03 TURNING GEAR
P09 GENERATOR MONITOR
P13 SENSOR FAILURE PROGRAM
CONTROLS SPEED & REJECTS ATS CONTROL ON CERTAIN SENSOR FAILURES
P07
ACCELERATION RATE
SPEED DEMAND
P10 VACUUM GLAND
CONTROLS SPEED
CONTROL OF DEF. SPEED REFERENCE
P08 BEARING METAL
CONTROLS SPEED
(CONTROLS ACCELERATION RATE & INITIATES SPEED HOLD, SPEED INCREASE OR SPEED DECREASE AS REQUESTED BY OTHER PROGRAMS)
BASIC CONTROL PROGRAM
P06 STEAM CHEST METAL TEMPS
CONTROLS SPEED
P05 VIBRATION
CONTROLS SPEED
P02 DIFF. EXP. ANTIC. METAL
CONTROLS SPEED
P04 ROTOR STRESS CONTROL
CONTROLS SPEED & ACCELERATION RATE
P12 LP EXHAUST TEMP.
CONTROLS SPEED
P11 ANTIC. DIFF. EXPANSION & DRAIN VALVE CONTROL
P01 ROTOR STRESS

ANTICIPATIVE TURBINE CONTROL

BACKGROUND OF THE INVENTION

1. Field of the Invention

This invention relates to automated control of turbine generating systems. More particularly, it relates to automatic speed and load control for such systems, and especially during times of turbine startup and load changing.

2. State of the Prior Art

Steam powered turbine generator systems typically involve a series of chambers through which pressurized steam is passed in succession, with the energy and the pressure of the steam being successively expended. A rotor passes centrally through the chambers, and rotation of the rotor is achieved by passage of the steam over blades alternately affixed to the rotor and to the casing.

Control problems arise, among other times, whenever the generator is to undergo substantial changes in speed and therefore in temperature, which most commonly occurs during startup. In such circumstances, care must be taken that the parts are not heated too rapidly, lest damage be done either by thermal stresses or by thermal expansion of adjacent parts at different rates. For example, when the cold turbine is being brought up to generating speed from a cold start, careful control must be maintained such that the rotor is heated within thermal stress limits, and also in a manner such that the rotor and casing undergo heat expansion at approximately the same rate. Since the rotor is smaller and has a higher heat transfer coefficient, it typically undergoes more expansion than does the casing. Accordingly, it is common at regular intervals during the startup procedure to hold the speed constant, such that thermal and spacial stability will be achieved before further acceleration. In some applications, these speed holds are only in the order of minutes, but for other, the holds may actually be for hours.

In the interest of efficiency, it is appropriate that the speed hold intervals be as limited in duration as is practicable, and that the entire startup process be controlled as accurately as possible.

One prior art startup control system is set forth in a paper entitled "computer Control of Turbine Generator Startup Based on Rotor Stresses" by R. G. Livingston, presented at the Joint Power Conference, A.S.M.E. and I.E.E.E. at New Orleans in September of 1973. In that control system, the unit is accelerated to various hold speeds, and, upon attaining a given hold speed, is held there as necessary until stress conditions permit the higher heating rate to the next speed hold point. The control system decides upon the terminating point for speed holds by periodically calculating the maximum stress which would result if the unit were to be taken to the next hold speed, utilizing the existing temperature mismatch and the corresponding increase in the convection coefficient that would result. The hold at the existing speed is continued until such calculation results in a stress lower than that deemed allowable. Thus, in accordance with that prior art system, predicted values of a turbine operating parameter are calculated under essentially static conditions, i.e., at a speed hold. Once the turbine leaves a given speed hold level and accelerates toward the next, no prediction calculations are made until the next hold level is reached. When the turbine is in load control, the load and loading rate are controlled as a function of rotor surface or bore thermal stress. Load is held when calculated surface or bore stress (in real time) exceed given control limits, and the loading rate is reduced as stresses increase.

Another type of prior art system is exemplified in U.S. patent application Ser. No. 247,887, filed by Theodore C. Giras and Robert Uram on Apr. 26, 1972, assigned to the assignee hereof and entitled "System and Method for Starting, Synchronizing, and Operating A Steam Turbine With Digital Computer Control." That application is hereby incorporated in its entirety by reference into the present application, and shall be referred to as "the referenced co-pending application." In the control system described in that application, an automatic turbine startup (ATS System) incorporates means for periodically calculating a representation of rotor stress, and comparing it with allowable limits. There is also incorporated means for periodically calculating anticipated differential expansion by extrapolation of prior values, and comparing same against limits. Both such anticipated representations are developed by straight linear extrapolation. While such a technique has proven successful in its own right, experience has shown that linear extrapolation techniques are at times extremely vulnerable to noise, and in the case of determining anticipated differential expansion, the thermal measurement noise which necessarily is introduced in the system is amplified by the extrapolation procedure. In fact, experience has shown that at some times, thermal noise may be so severe, and the extrapolated representations therefore so inaccurate, that alarm messages derived therefrom are not even made available to the operators.

In yet another prior art system, described in U.S. Pat. No. 3,446,224 to Zwicky, predictors are utilized in calculating a predicted stress margin. The values of calculated stress margin from the sequential calculations are stored and shifted from one location to the next, and then used to predict a future value of stress margin. Thus, the Zwicky patent represents a different, and somewhat rudimentary form of extrapolation of a representation of stress.

OBJECTS OF THE INVENTION

It is accordingly a primary object of the present invention to furnish apparatus and methods for the control of turbine systems as a function of model determined anticipated turbine operating parameters.

It is a further object to provide an improved method of determining anticipated values of differential expansion and of controlling turbine operation therewith.

Yet another object is to provide an improved method of modulating turbine acceleration during startup periods.

A further object is to provide improved monitoring apparatus for demonstrating to the turbine operator how the present rate of speed or load increase will affect future operating parameters, so as to alert the operator of the necessity or desirability of manual, rather than automated control.

It is a still further object of the present invention to provide a method and means for continuously changing the speed profile of a turbine during startup, so as to optimize the startup time with respect to predetermined monitored turbine operating parameters.

Another object of the present invention is to provide a method and means for continuously determining a plurality of future turbine operating parameters, and for controlling the operation of the turbine as a function of such determined parameters.

It is a still further object of the present invention to provide means and methods for predicting what will be the operating consequence of a given control action, before the action is taken, utilizing a methematical model which may be responsive to a large variety of operating parameters, including bolt-flange temperatures, steam valve casing temperatures, first stage steam temperatures, or the like.

SUMMARY OF THE INVENTION

In accordance with the principles of the present invention, electric turbine generators are operated through desired speed-time profiles utilizing anticipative manipulation based on anticipated turbine differential expansion and rotor stresses. Turbine operating parameters such as present speed and first stage temperature are monitored on a frequent periodic basis, and immediately successive values are obtained either from known speed profile or from extrapolation of the observed operating conditions such as first stage temperature. Thereupon, on the basis of the future speed and the estimated future temperature, anticipated stress and differential expansion is developed in accordance with the mathematical functions of a rotor model. These directly and frequently determined anticipated critical quantities in turn allow for effective and accurate observation and control of the rotor speed. That is, although the effectiveness of the principles of the present invention as a control strategy is rooted in operations and calculations based on a mathematical model, a whole new control loop actually emanates therefrom.

In an illustrative embodiment, steam temperatures at the inlet and exhaust ports of each element of the turbine are averaged, and together with present speed, are utilized to calculate present steam to rotor and steam to casing heat transfer coefficients. From the heat transfer coefficients and physical properties of the metal, propagation of heat within the metal is developed, and from those quantities, the present surface and volume average temperature of the rotor and casing may be developed. The anticipated speed is evaluated for the next execution, and with either the present or extrapolated steam temperatures, is utilized to calculate anticipated heat transfer coefficients and turbine thermal time constants. From these, in accordance with the mathematical model utilized for present temperatures, anticipated rotor surface and rotor and casing volume average temperatures are evaluated. Anticipated rotor stress is developed from the difference between the anticipated rotor surface temperature and the anticipated rotor volume average temperature.

Anticipated differential expansion is evaluated based on the difference between the anticipated casing volume average temperature and the anticipated rotor volume average temperature corrected for error. The respective anticipated diferential expansion and stress quantities are in turn compared with predetermined limits for purposes of speed or load control.

BRIEF DESCRIPTION OF THE DRAWINGS

FIG. 2 shows an overall block diagram for the periodic programs used for automatic turbine startup in a known digital control system, but with modifications in accordance with the principles of the present invention.

FIGS. 3B, 3C and 3D represent further detail of the steps enclosed by the borken line of FIG. 3A.

DETAILED DESCRIPTION

As used herein, the term "differential expansion" is used to refer to the difference in expansion or contraction of different apparatus or structures relative to one another. The term "incremental expansion" is used to refer to the expansion or contraction of a given element or structure. Both terms may be expressed as absolute dimensions, or as percent changes.

Figure 1A:
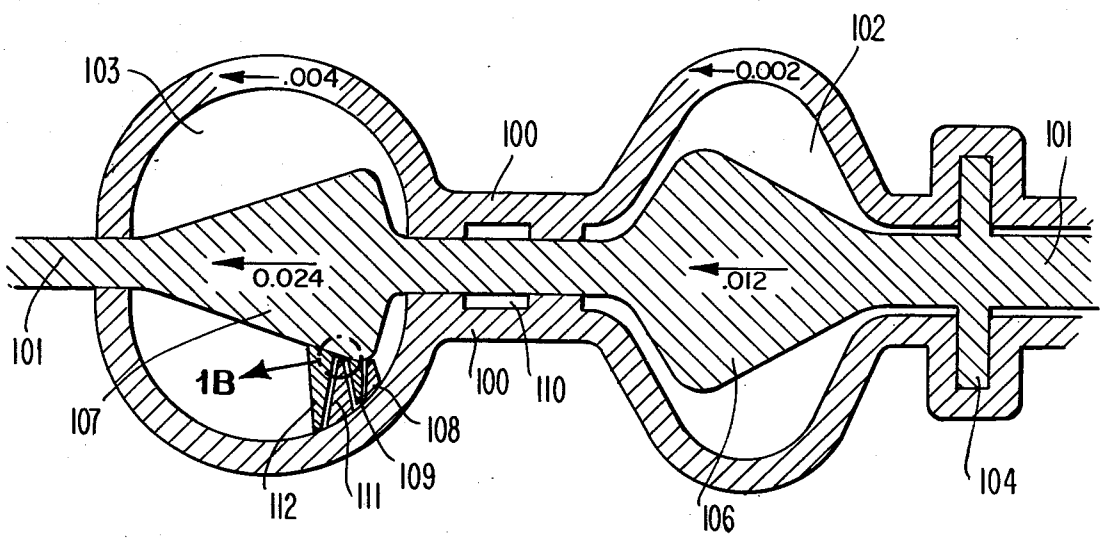
FIGS. 1A and 1B symbolically show turbine rotor and casing parts in a fashion which illustrates the problems encountered by unwarranted differential expansion.
Figure 1B:
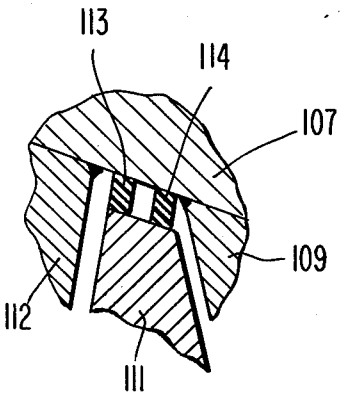

The problem of differential expansion is illustrated by FIGS. 1A and 1B, which symbolically depict a rotor and casing of a typical steam turbine generator. The turbine 101 rotates within the casing 100, the turning motion being facilitated by a thrust bearing arrangement symbolically represented at 104. In FIG. 1, steam is introduced from the central portion 110, and passes outwardly into two cavities 102 and 103. The rotor itself forms tapering portions 106 and 107, respectively, in the cavities 102 and 103, at which points the blades are located. For purposes of simplification, only a few blades in the second chamber 103 are shown, alternate blades such as 108 and 111 being affixed to the casing 100, with interleaved blades such as 109 and 112 being attached to the rotor 101. In typical fashion, the blades increase in size the further they are located from the introduction point of the steam, such that the relatively spent steam will work on a greater area of blade, thereby still providing adequate rotating force for the rotor 101. As is shown in FIG. 1B, which is an enlargement of the circular broken line cutout of FIG. 1A, the blades are respectively provided with seals 113 and 114 which prevent leakage back of the steam, and thereby which facilitates useful passage of the steam over the whole succession of the blades.

In practice each tubine generally involves elements on the other side of the thrust bearing 104. Thus, it is convenient to designate one side the "generator end" and the other side the "governor end". Also, from the standpoint of effective control operations, and especially for mathematical modelling purposes, it is useful to consider lateral segments of the apparatus, demarcated by imaginary planes transverse to the rotor, as "elements". The element breakup may be as simple as including a chamber such as 102 or 103 in each element, or may represent finer gradiations, depending on the complexity of the model desired.

The differential expansion problems occur as follows. As steam is introduced during startup or acceleration, the rotor 101 and the casing 100 are subjected respectively but unevenly to increase temperatures. The large bearing 104 provides a relatively fixed point both for the rotor 101 and for the casing 100. As the rotor and casing heat, therefore, and concomitantly expand, the expansion may be deemed to take place relative to the bearing location 104. Due to the central location of the rotor 101 to passage of steam, and to the fact that the turning rotor has a higher surface speed, the thermal incremental expansion of the rotor tends to be considerably larger than that of the casing. Illustrated in FIG. 1A are typical of incremental expansion values 0.012 for the rotor versus 0.002 for the casing in the first chamber, which is doubled to 0.024 versus 0.004 by adding the further expansion in the second chamber 103. The result, of course, is a substantial lateral dislocation of the various rotor components relative to corresponding parts of the more slowly expanding casing, i.e., a differential expansion of 0.02. The most crucial aspect of such expansion occurs at the seals such as 113 and 114 between the casing blades and the rotor body. That is, due to the increasing size of the blades from the steam inlet to the steam exhaust of a chamber, and the concomitant tapering of the rotor, it is necessary to control differential expansion between rotor and casing lest the tapered rotor portion 107 expand so far relative to the casing that the seals such as 113 and 114 are damaged or destroyed. With respect to the other cavity 102, which tapers in the opposite direction, the same problem would occur on the seals between the blades attached to the rotor and the casing wall.

One other such problem are stresses which build up within the rotor itself due to its accomplishment of work and the buildup of heat unevenly therein. In accordance with the principles of the present invention, damage or destruction of any of the parts are to be avoided.

Within the foregoing context, the necessity for careful control of speed, acceleration, and temperature is quite evident. Due to the immense size and cost of the generation equipment involved, there is furthermore a tendency to maintain and conduct the control process in an extremely conservative fashion. This is done typically by utilizing a multilevel speed-time profile, which has various plateaus at which constant speed is maintained until the differential expansion between the rotor and the casing returns to a safe minimum. Increasingly, however, fuels are becoming more and more expensive, thereby imposing substantial penalties in operating costs for each unnecessary moment of speed hold.

Control loops embodying the principles of the present invention substantially reduce the occurrence of unnecessary and/or wasteful speed holds to compensate for thermal stress and differential expansion factors.

In U.S. Pat. No. 3,741,246 to A. Braytenbah, which is assigned to the assignee hereof, there is described a digital control system for electric turbine generators. FIG. 1 of that application is a schematic depiction of a typical turbine generator, including the standard speed and detection apparatus, standard valves and controls therefor, and appropriately interacting actuators. That drawing is exemplary of apparatus to which the principles of the present invention may advantageously be applied, in that it shows many observation and control parameters which may be utilized. It is to be understood, however, that the principles of the present invention are not limited merely to the control quantities set forth therein. In FIG. 2 of the same patent, there is set forth an exemplary block diagrammatic layout of a programmed digital computer, operator interface apparatus, and the various turbine and generating plant facilities. The principles of the present invention are adapted to operated advantageously in the context of a system such as set forth in FIGS. 1 and 2 of the Braytenbah patent.

In the referenced copending patent application, which is assigned to the assignee hereof, and other continuation and cross-referenced applications listed therein, there is described a comprehensive digital control system for turbine systems. Among the comprehensive set of programs listed and described therein, there is shown at FIGS. 67-2 a block diagram of a series of periodic programs for automatic turbine startup. Interactively shown in that drawing are 15 different programs, labeled P01 through P15, which function together to produce an acceleration rate and a speed demand for the basic digital control program. Disclosures of the purpose and functioning of those various programs are set forth in detail in the referenced copending application, and shall therefore not be referred to in detail herein except to the extent that they are altered by provision for the principles of the present invention.

In accordance with the principles of the present invention, which provides control on the basis of anticipated differential expansion and rotor stress control, changes are necessitated principally in programs P01, P04, P11, and P07. FIG. 2 sets forth a block diagram of periodic programs for automatic turbine startup adapted for incorporation of the principles of the present invention. In particular, FIG. 2 is configured to the extent possible similarly to FIG. 67-2 of the foregoing referenced copending application, but with a new altered control loop also being shown. More particularly, while in the reference application, acceleration rate and sped demand passed only from P07 to the basic control program, in FIG. 2 they also provide input for P11, the anticipated differential expansion and drain valve control program. As in the prior art, another input to that program is from P06, the steam chest metal temperature control program. Moreover, the acceleration rate and speed demand of program P07 are also fed back as inputs for program P04, the rotor stress control program. As before, program P01 provides rotor stress information for program P04. Finally, the output of P11, the anticipated differential expansion program, is passed into program P07, the speed reference control program, but on a different basis than was done in the prior art. It may therefore be seen from FIG. 2 that an entirely new interactive control loop is set up by incorporation of the principles of the present invention. Following are block diagrammatic representations of the various programs which embody the principles of the present invention, and constitute the watershed for the new control loop indicated in FIG. 2. As in FIG. 2, the following block diagrams are constituted identically to those of the referenced co-pending application, and shall not be described in detail except to the extent necessary to illuminate the incorporation of the principles of the present invention.

Figure 3D:
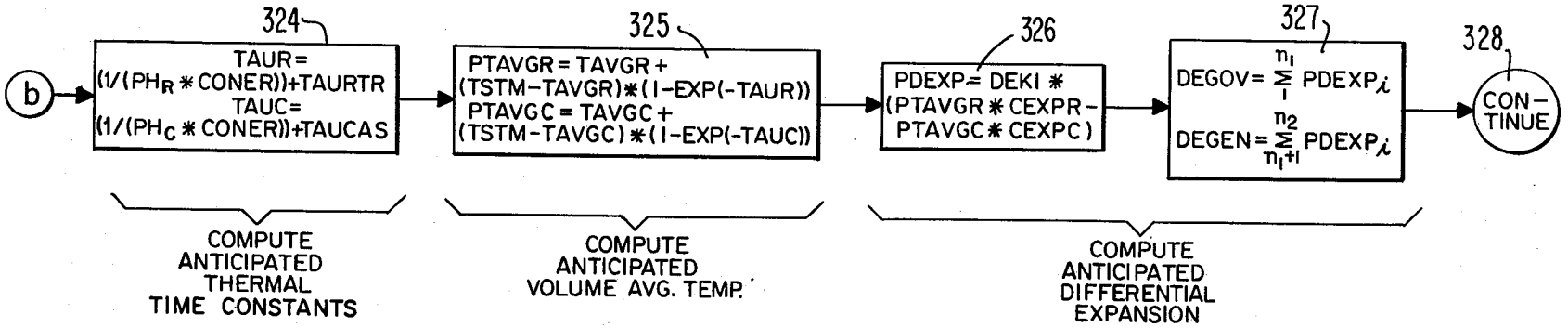
FIGS. 3A through 3D show a detailed block diagram of the anticipated differential expansion and drain valve control program, P11, of the FIG. 2 block diagram, with the parts incorporating the principles of the present invention enclosed by broken lines in FIG. 3A. More particularly.
Figure 3A:
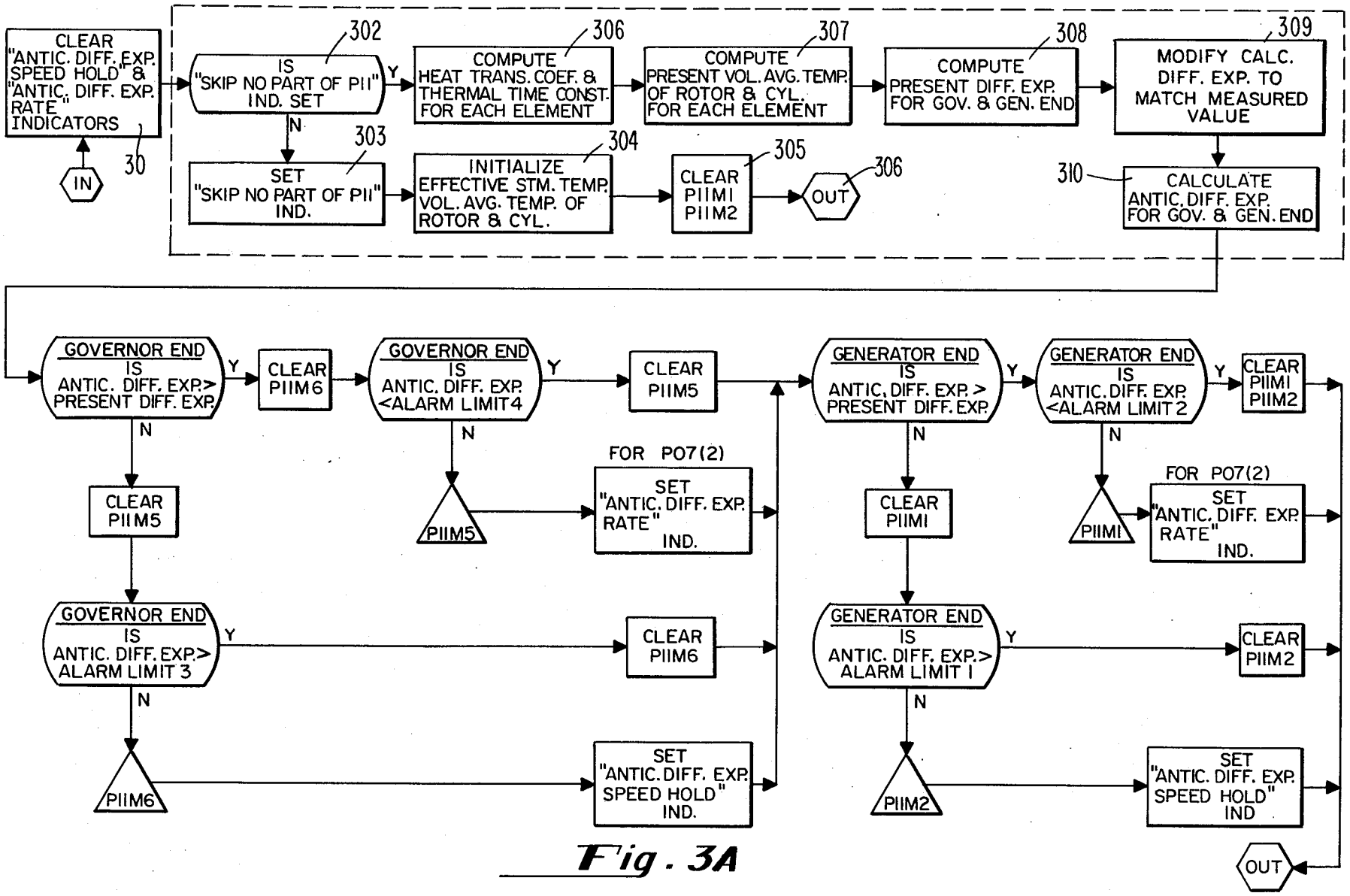

FIG. 3A shows a block diagram of program P11, the anticipative differential expansion program. In FIG. 3A, the portion encircled by a broken line constitutes the part which has been altered from FIGS. 67-10A and 67-10B of the referenced co-pending application. Since the referenced co-pending application evaluates anticipated differential expansion only by a simple linear extrapolation, both at the generator and at the governor ends of the rotor, it begins by initializing the appropriate extrapolation variables, and then computing the extrapolations every five minutes by linear interpolation (e.g., $T_A = T_{-5} + 5(T_{-5} - T_{-6})$). Thereupon, the remaining sundry comparison steps relate to whether the computed differential expansion indicator is greater or less than specified limits, whereupon the speed of P07 could be overridden, as necessary.

In FIG. 3A, the two override indicators, including anticipative differential expansion speed hold and anticipative differential expansion rate indicators, which are developed in accordance with the principles of the present invention and which when necessary are coupled to P07 are cleared at 301. Next, entering the broken line segment, at 302 a check is made whether the indicator "skip no part of P11" is set. This indicator is designed to be set during the first run of the program, for the purpose of eliminating meaningless data which may have been in storage. If it is the first run, and the indicator has not been set, the path to 303 is followed, whereupon the indicator is set. Thereupon, at 304, appropriate variables are initialized, including the effective steam temperature and the volume average steam temperatures of the rotor and cylinder. Also, at 305, memory locations P11M1 and P11M2, associated with the variables of 304, are cleared. Then, the program exits at 306 for a complete execution with all variables properly set and memory locations appropriately cleared in preparation for processing.

If it is not the first run through the program, the "skip no part of P11" indicator has been set, and the flow passes from 302 to 306, commencing evaluation of anticipated differential expansion. In accordance with the principles of the present invention, a mathematical model which segments the generator into convenient elements is to be utilized to evaluate anticipated differential expansion. The input quantities available to that end are the present speed and the present inlet and exhaust temperatures for each element of the generator. In order to insure that the calculation of anticipated differential expansion is accurate and reliable, the same model is first used to evaluate present differential expansion, and that evaluated quantity is compared with a measured value, thereby yielding a correction factor to be fed back into the model for evaluation of anticipated expansion.

At 306, the coefficient of heat transfer from steam to metal, and the thermal time constant for conduction of heat within the respective metal parts are both calculated, utilizing their own past values together with present temperature and speed. In this fashion, the values of the constants are not only used for calculation of differential expansion, but they furthermore build into the model a cumulative history of speed and temperature.

At this point, the steam temperature, the prior temperature of the metal parts, and the rates of heat transfer from steam to metal and conduction within the metal are known, so that the volume average temperature of the rotor and the casing may be computed. Although in fact the temperature of the respective items is not entirely homogeneous, it has been determined that a volume average temperature adequately characterizes the heat conditions from the standpoint of predicting differential expansion.

As represented at 308, the present differential expansion is calculated both for the governor and generator ends by multiplying the volume average temperature by appropriate constants.

In partial summary, the operations represented at 306 through 308 together embody a mathematical model for calculation of differential expansion. If present values of temperature and speed quantities are utilized, present differential expansion results. Correspondingly, if future temperature and speed quantities are utilized, anticipated differential expansion results. However, in order to insure accuracy of the anticipation, the calculated present differential expansion may be compared to an actual measured value to provide compensation for any error in the model. The corrections are represented at 309, whereupon the model is prepared to calculate the anticipated differential expansion, which also is done both for the governor and generator ends. In accordance with preferred embodiments, the anticipated differential expansion is developed utilizing subsequent speed values from the speed profile utilized, together with extrapolations of input and exhaust steam temperatures of the various elements.

Upon completion of the process represented at 310, anticipated differential expansion quantities have been developed, and the procedure exits from the broken lined portion to execute the standard comparison steps to determine whether the resultant differential expansion is excessive. The following steps, which are common to the referenced co-pending application, generally function to determine whether the anticipated expansion quantities are within allowable limits, or whether they exceed those limits. Assuming the former case, the speed control program P07 functions without interruptions, but in the latter case speed hold or rate limiting indicators are set, thereby causing an override function to arise in the speed reference program P07.

Figure 6:
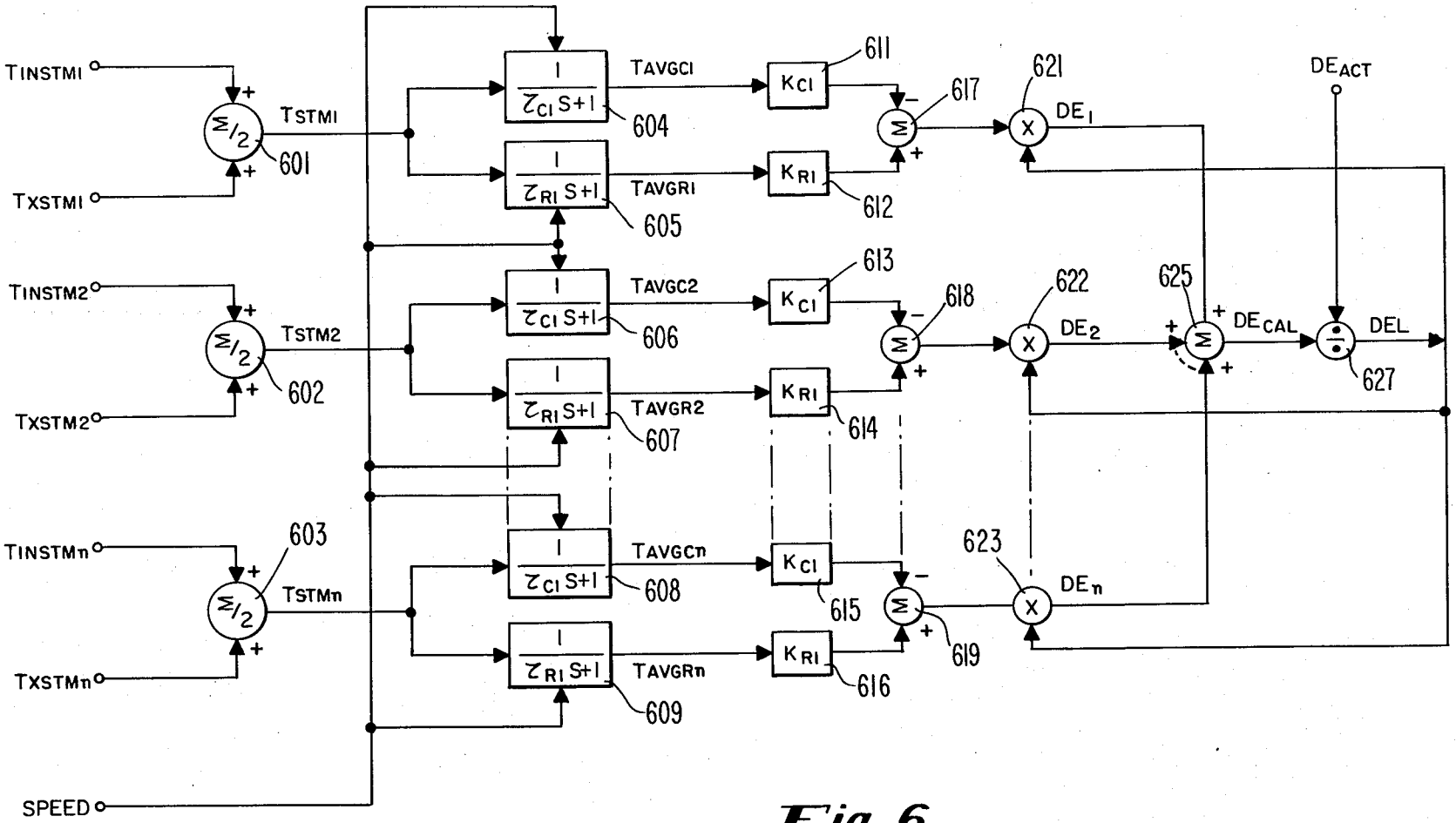
FIG. 6 shows a block diagram of an illustrative model for computing anticipated differential expansion in accordance with the principles of the present invention, and represents a part of the foregoing program P11.

The procedures set forth in FIG. 3A may perhaps be better understood by consideration of FIG. 6, which schematically represents the mathematical model utilized. A plurality of parallel paths designated "1" through "n" are provided, one for each element of the turbine. For each such element, the inlet steam temperature, TINSTM, and the exhaust steam temperature, TXSTM, are averaged at 601, 602, 603, etc. The average steam temperatures for the elements, TSTMN, are thereby provided for the next subsequent operations of computing the constants for the casings and the rotor (respectively represented in FIG. 6 as $\tau_{Cn}$ and $\tau_{Rn}$), and the consequent evaluation for the casing and for the rotor portions of each element of volume average temperature, TAVGC and TAVGR. In view of the exponential nature of heat transfer, the calculations of volume average temperature at 604 through 609, etc., are rendered in the frequency domain utilizing the Laplace operator "s".

The volume average temperatures in turn are converted to incremental expansion quantities at 611 through 616, etc., by multiplication of each by appropriate constants $K_{Cn}$ and $K_{Rn}$. Then, for each element, the difference is taken at 617 through 619, etc., between the respective casing incremental expansion and rotor incremental expansion, yielding a differential expansion for each element. Without more, these elemental differential expansions might be combined to yield the present overall calculated differential expansion. Prior to the combination, which occurs at 625, however, the individual calculated differential expansions for each element are coupled to a multiplier such as 621 through 623, where a feedback correction constant, designated DEL, is applied. During the execution of the procedure for calculation of present differential expansion, the fedback correction constant DEL is equal to the value developed during the prior iteration. Therefore, during the execution for evaluation of present differential expansion, the contributions of each element, appropriately corrected, are added to the rest at 625 to yield $DE_{cal}$.

At 627, a ratio is taken of an actual, measured differential expansion for the entire unit, $DE_{act}$, compared with the calculated present differential expansion from 625, $DE_{cal}$. This ratio, DEL, effectively tests the accuracy of the foregoing procedures, in that the ratio depicts the closeness of the calculated present differential expansion to the measured present differential expansion. The correction factor DEL is fed back to the respective multipliers 621 through 623, to provide correction in calculating anticipated differential expansion.

Thus far, the discussion of FIG. 6 corresponds to steps 306 through 309 of FIG. 3A. The next step of FIG. 3A, step 310, the calculation of anticipated differential expansion, takes place by re-executing the procedure of FIG. 6 through the combination step 625, utilizing the recently calculated correction factor DEL at 621 through 623, using the known future speed at the time for which differential expansion is being anticipated, and utilizing either the same or else new extrapolated temperatures TINSTMn and TXSTMn for the respective temperature inputs. The resultant quantity produced at 625 is the anticipated differential expansion which is passed in FIG. 3A from 310 for comparison with various limits to determine whether speed should be altered for reasons of excess differential expansion.

In summary, FIG. 6 represents an illustrative embodiment of the principles of the present invention, whereby present speed and temperature is utilized in conjunction with prior speeds and temperatures to calculate a present differential expansion, and to derive a correction factor therefrom. Thereupon, the procedure is re-executed, but utilizing a future speed quantity and extrapolated steam temperatures as input values. On a real time basis, therefore, the model is in effect exercised twice for each calculation of anticipated differential expansion. Since calculations in FIG. 3A are done both on the basis of the governor and the generator ends, each of the calculations must of course be done over for each end. Although an iterative treatment is rendered for DEL, the correction factor, it is also possible to operate by initializing that factor to unity prior to each new evaluation of present differential expansion.

Figure 8:
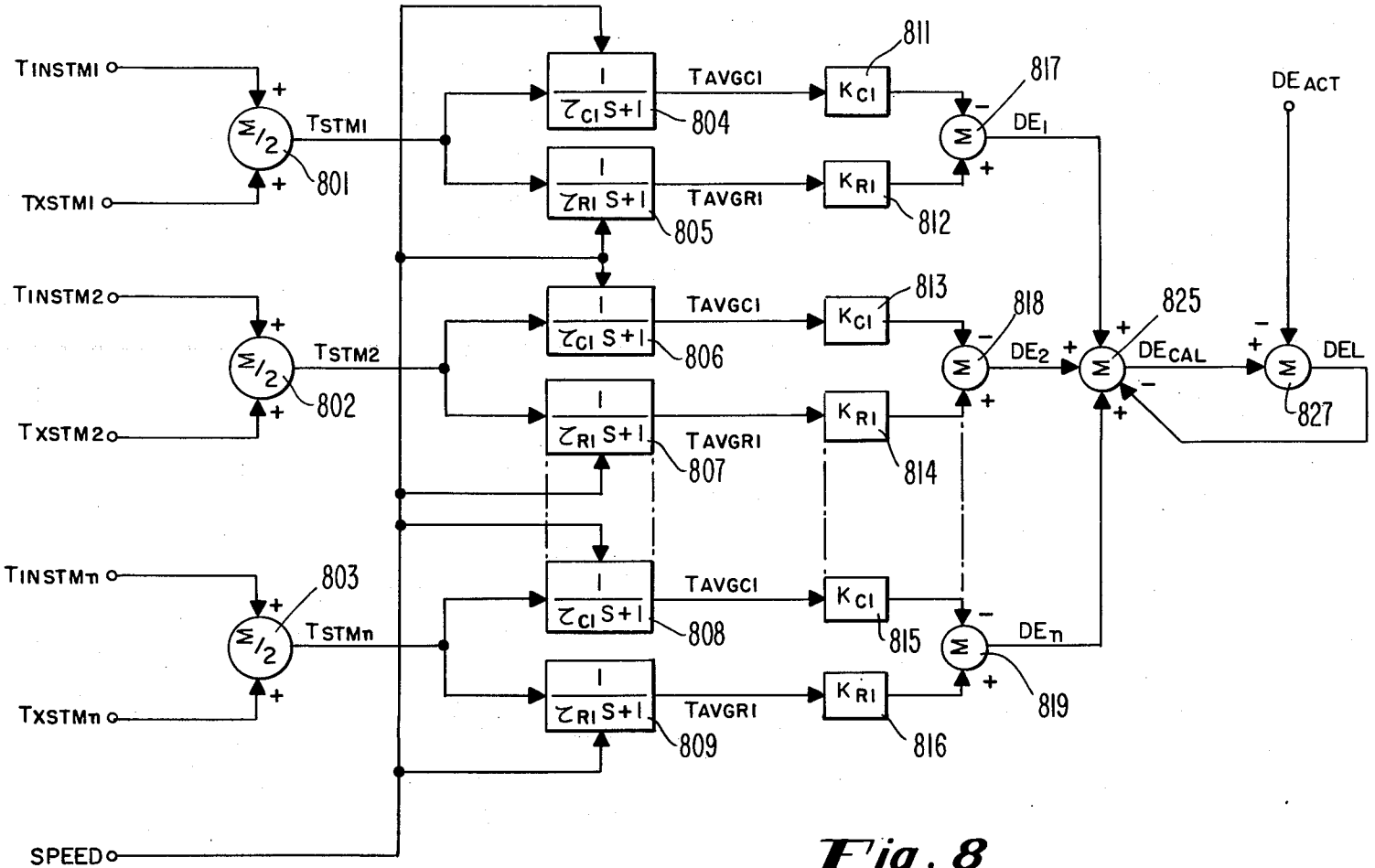
FIG. 8 shows an alternative model to that shown in FIG. 6.

FIG. 8 is configured in the same manner as FIG. 6, but illustrates an alternative method for correcting the model based on comparison of calculated and actual differential expansion values. In FIG. 8, input steam temperatures are averaged as in FIG. 6, and volume average temperatures for the rotor and casing of the respective elements are evaluated at 804 through 809. The constants $K_{CN}$ and $K_{RN}$ are applied at 811 through 816, and the difference between rotor and casing incremental expansions are evaluated at 817 through 819, yielding the element differential expansions $DE_N$. It is to be noted that the multiplicative feedback correction at 621 through 623 of FIG. 6 has been eliminated. Rather, the respective element differential expansions are summed at 825 to yield the calculated differential expansion, from which the measured differential expansion is subtracted at 827 to yield a correction factor DEL. This correction factor in turn is subtractively combined at 825 with the respective element differential expansions to correct the model for the next exercising thereof, to determine anticipated differential expansion.

The embodiment of FIG. 8 therefore operates as follows. In contrast to the development of a ratio type error term, which is multiplied against the various element differential expansions for correction, a differential type expansion error DEL is evaluated by subtraction. Then, rather than being utilized multiplicatively for correction, subtractive correction is utilized at 825. For each exercising of the model, a new correction factor DEL is evaluated, and applied back to correct the model for evaluation of the next subsequent calculated differential expansion.

Whether or not the embodiments set forth in FIG. 6 or FIG. 8 are to be utilized will depend upon the nature of the apparatus being controlled. Clearly, if there exists a possibility for a large variation in the ratio type correction factor of FIG. 6 to the calculated differentials themselves, the addition-subtraction embodiment of FIG. 8 will be preferable. However, if the ratios are reasonably small relative to the calculated differentials themselves, the FIG. 6 mode may be preferable.

It may be further noted that while both the embodiments of FIG. 6 and FIG. 8 are based on average first stage steam temperatures, as exemplified between the input and exhaust steam temperatures, the models of FIG. 6 and FIG. 8, and their corresponding embodiments in the other figures, may be made responsive, as set forth in the objects of the present invention, to many other operating parameters, such as bolt-flange temperature, steam valve casing temperatures, and the like.

Figures 3B, 3C:
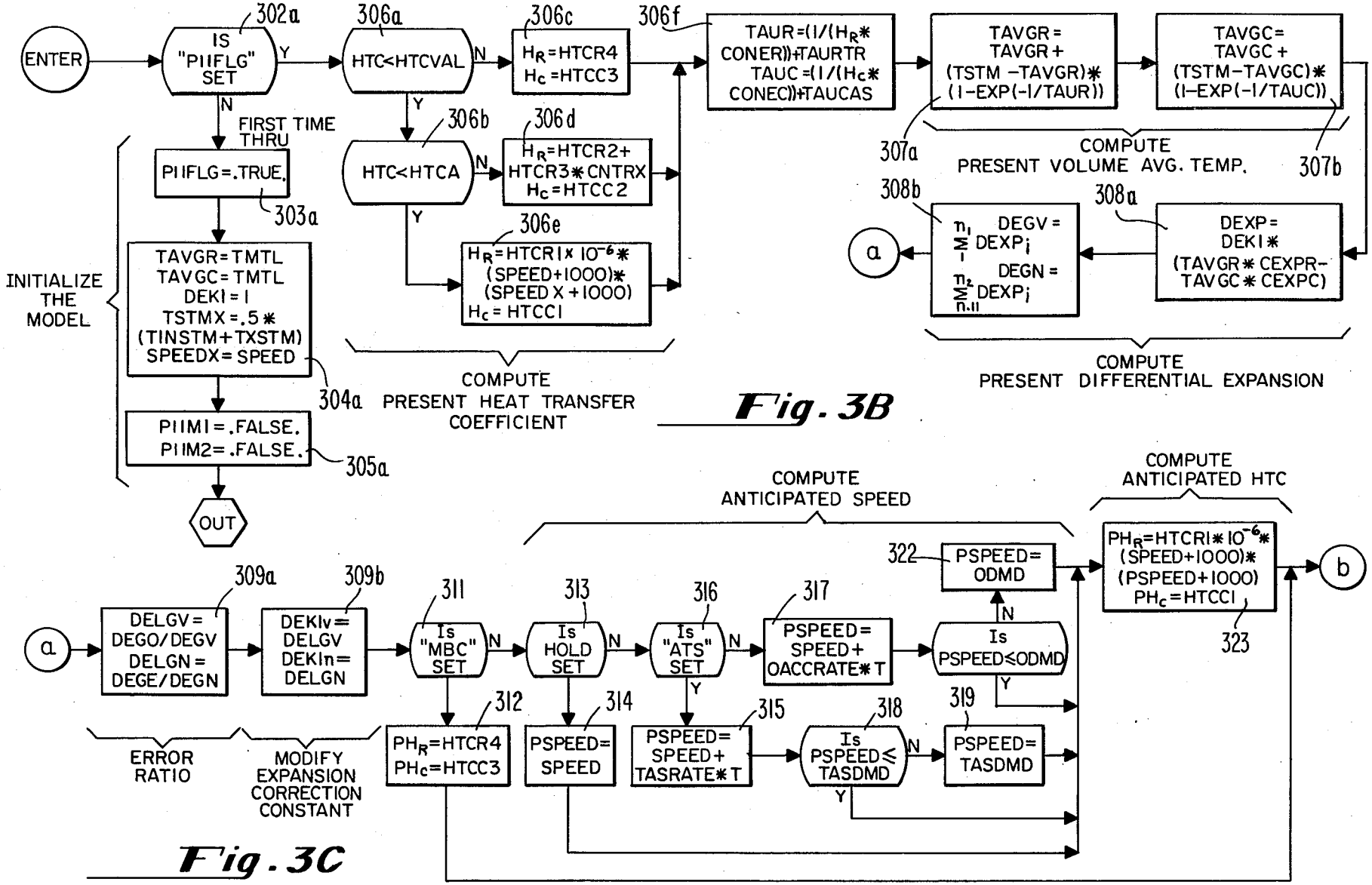

FIGS. 3B through 3D set forth a detailed flow diagram of operations 302 through 310 of FIG. 3A, in accordance with the embodiment of the principles of the present invention utilizing the model of FIG. 6. FIGS. 3B, 3C and 3D sequentially follow one another, with the transitions appropriately indicated by continuations "a" and "b". Each of the individual steps of FIGS. 3B through 3D are stated either in terms of conventional mathematical operations, conventional programming statements, or conventional decision options corresponding to well known programmable routines. The variables utilized in FIGS. 3B through 3D are listed and defined in Appendix 1 hereof, and correspond largely to the notation utilized in FIG. 6.

Upon entry at the beginning of FIG. 3B, the "skip no part of P11" indicator, designated by the variable P11FLG, is tested, as at 302 in FIG. 3A, and if not set, the lower, or "no" branch is followed to initialize the model. Accordingly, operations 303*a*, 304*a* and 305*a* correspond respectively to operations 303 through 305 of FIG. 3A, and function to set the indicator P11FLG, initialize the speed, average steam temperature, the rotor and casing volume average temperatures, and the differential expansion correction constant, and to clear the memory locations P11Mn. As in FIG. 3A, this path is followed only during the first execution of the program. Assuming the P11FLG indicator is set at 302b, the "yes" path is followed to begin computation of the present heat transfer coefficient, designated $H_R$ for the rotor and $H_C$ for the casing.

At 306a through 306e, alternate approaches to calculation of the heat transfer coefficients $H_R$ and $H_C$ are rendered, depending on present operating conditions. From program P01, a heat transfer coefficient designated HTC is developed in order to establish stress related control. That HTC value is utilized in 306a and 306b for choice of constants $H_R$ and $H_C$ in the differential expansion calculations. In particular, at 306a and 306b, HTC is compared with two reference levels, which are correlated with different operating conditions. In response, therefore, to those operating conditions, the constants $H_R$ and $H_C$ are set variously to constants, or are made a function of speed.

Generally, the heat transfer coefficient computations at 306a through 306e correlate the transfer of heat from steam to the metal parts as a function of speed. Since the casing is not moving, its exposure to steam is unchanged, but the various rotating speeds of the rotor determine how much heat it will absorb from the steam. Basically, the faster the rotor moves, the more heat it will tend to absorb from the steam. The constant values HTCCn and HTCRn are chosen in accordance with this theory, and fit into the calculation of $H_R$ and $H_C$ as shown in 306c through 306e. When the quantities $H_R$ and $H_C$ have been thusly evaluated, thereby characterizing passage of heat from the steam to the surface of the casing and rotor, the propagation of heat within the rotor may be characterized in terms of the thermal time constants TAUR and TAUC, which are functions of the configuration and composition of the parts, as well as of the recently computed heat transfer coefficients. At 306f, TAUR and TAUC are directly computed from $H_R$ and $H_C$, basic thermal time constants TAURTR and TAUCAS, and co-factors therefor designated CONER and CONEC. In turn, the rotor and casing thermal time constants respectively characterize propagation of heat through the respective parts, and allow the computation of the present volume average temperature of the parts. The foregoing production of the heat transfer coefficients $H_R$ and $H_C$ and of the thermal time constants TAUR and TAUC correspond in FIG. 6 to the development of the various quantities $\tau_{CN}$ and $\tau_{RN}$.

As represented in FIGS. 307a and 307b, the volume average rotor temperature TAVGR and the volume average casing temperature TAVGC are exponential calculations based on prior values of same, the difference between the present steam temperature and the prior volume average temperature, and the exponential propagation in association with the thermal time constants TAUR and TAUC. The arithmetical form rendered in 307a and 307b corresponds to the Laplace designation at 604 through 609 of FIG. 6.

Next, at 308a and 308b, the present differential expansion is developed. Specifically, 308a represents calculation of the present differential expansion for each element, the expansion factor DEXP corresponding to the quantities $DE_n$ of FIG. 6. Hence, the temperature to expansion constants $K_{Cn}$ and $K_{Rn}$ of 611 through 616 of FIG. 6 are expressed in terms of co-factors CEXPR and CEXPC in FIG. 3A, and the correction factor DEL is rendered in terms of the dummy variable DEK1.

After each of the elemental differentials DEXP are evaluated at 308a, they are summed at 308b, once for the governor end and for the generator end to yield total present differential expansions DEGV and DEGN, which correspond to the quantity $DE_{CAL}$ produced at 625 of FIG. 6. Next, as represented by the continuity factor "a", flow passes from FIG. 3B to FIG. 3C.

At 309a an error ratio is developed, once for the governor end and once for the generator end, utilizing actual measured differential expansions DEGO and DEGE, and the calculated present differential expansions which were just computed at 308b. This corresponds to the division at 627 of FIG. 6. Next, at 309b, the expansion correction constants for the differential expansion computations, DEK1, are altered in accordance with the just calculated error ratio.

In summary, the operations of FIGS. 3B and 3C up to 309b correspond to a single execution of the FIG. 6 model, and pave the way for exercising the model to evaluate anticipated differential expansion. The first step in the anticipation of differential expansion is evaluation of the anticipated speed.

In general accordance with the speed control of FIG. 2 and as set forth in the referenced co-pending application, several control modes for establishing and altering speed may be utilized. The generator may be operating at load, with the main breaker closed, or it may be in a startup mode, either at a speed hold or under the automatic or manual turbine speed control of P07. In each case, the anticipated differential expansion expression must utilize an anticipated speed in accordance with the known operating mode. In turn, the anticipated speed is utilized to evaluate anticipated heat transfer coefficients, which in turn are utilized to evaluate anticipated thermal time constants. At 311, the MBC (i.e., main breaker closed) indicator is checked, to determine whether the system is operating at load. If so, the speed is known and the anticipated heat transfer coefficients $PH_R$ and $PH_C$ are equal to their known at-load values, HTCR4 and HTCC3, as set in 306c. If MBC is not set, a check is made at 313 whether there is currently a speed hold. If so, the speed is of course known and at 314 the anticipated speed PSPEED is set to the speed of the hold value. If the system is not at a speed hold, at 316 the ATS (i.e., automatic turbine startup) indicator is checked. If it is set, at 315 the anticipated speed is made a function of the scheduled rates and times in accordance with the ATS program. If the ATS indicator is not set, the machine is under manual control and the anticipated speed variable PSPEED is set in accordance with time and with the manually set rate OACCRATE.

In the case of computation of anticipated speed either under automatic startup mode at 315 or under manual control mode at 317, certain levels designated TASDMD for the automatic mode and ODMD for the manual operated mode are set as hold limits. Thus, it would make no sense for the anticipated speed as set at 315 or 317 to be utilized if it is greater than a pre-set level at which it is known speed will be held. Accordingly, at 318 and 321, the respective anticipated speed quantities are compared with the hold levels TASDMD and ODMD. In either case, so long as PSPEED is less than or equal to the hold level, the computed PSPEED is utilized as anticipated speed, following the yes branch from 318 or 321. However, if the anticipated speed quantity is greater than the known hold level, the no branch is followed from 318 or 321 to 319 or 322, respectively, and the anticipated speed PSPEED is set to the respective automatic or manually determined hold levels TASDMD and ODMD.

Regardless of the mode utilized, an anticipated speed has been thereby developed, and assuming the MBC indicator was not set, an anticipated heat transfer coefficient is to be evaluated. At 323, anticipated coefficients $PH_R$ and $PH_C$ are calculated utilizing the same procedures as set at 306*e*. Then, as indicated by the continuation factor "b", flow passes from FIG. 3C to FIG. 3D.

Steps 324 through 327 of FIG. 3D are the same as steps 306*f* through 308*b* of FIG. 3B, except that anticipated heat transfer coefficients $PH_R$ and $PH_C$ are first utilized, anticipated thermal time constants TAUR and TAUC are evaluated in response thereto, anticipated volume average temperatures PTAVGR and PTAVGC result therefrom, and anticipated differential expansions are computed as a result. As set forth in the discussion of FIG. 6, the anticipated temperatures of the steam which are utilized may either be the same average steam temperatures used for calculation of the present differential expansion, or extrapolated values based on steam average temperatures from the prior several iterations. In FIG. 3D, the same steam temperatures TSTM are utilized.

Thus, at 327, anticipated differential expansion quantity for the governor end, DEGOV, and the generator end, DEGEN, are evaluated, and are passed on to the remainder of the operations of P11 to be utilized to set the anticipated differential expansion rate and speed hold indicators when and as appropriate. The continue step 328 of FIG. 3D corresponds to passage of flow from the broken lined enclosure of FIG. 3A to the further comparision steps as in the referenced copending application.

The foregoing discussion in conjunction with FIGS. 3A through 3D and 6 illustrates a preferred operation for control utilizing anticipated differential expansion evaluated from a predetermined mathematical model. As set forth hereinbefore, control also is achieved in accordance with the principles of the present invention utilizing anticipated rotor stress as a control quantity. In particular, preferred embodiments of the present invention include utilization of anticipated rotor stress evaluated in accordance with a model similar to that used for anticipated differential expansion.

In the referenced co-pending application, programs P01 and P04 periodically evaluate rotor stress, compare it with allowable values, and on the basis of the comparison, regulate the speed control program P07. As set forth in FIG. 2, programs P01 and P04 also maintain supervision over the speed reference P07 by means of rotor stress evaluation and control. In contrast with the stress responsive speed and acceleration rate control of the referenced co-pending application, which utilized only an accumulation of priorly developed present stress quantities, plus an extrapolated future quantity, embodiments of the present invention actually develop an anticipated stress quantity in a similar manner to the evaluation of anticipated differential expansion. That is, high pressure turbine steam temperatures and speed are utilized to evaluate a present steam to rotor heat transfer coefficient, the present rotor surface temperature, and the present rotor volume average temperature to evaluate present stress. Then that same model is exercised again utilizing anticipated speed (and/or steam temperatures) to evaluate anticipated heat transfer coefficients, anticipated rotor volume average temperature, anticipated rotor surface temperature, and from those quantities, anticipated rotor stress and strain.

Figure 4A:
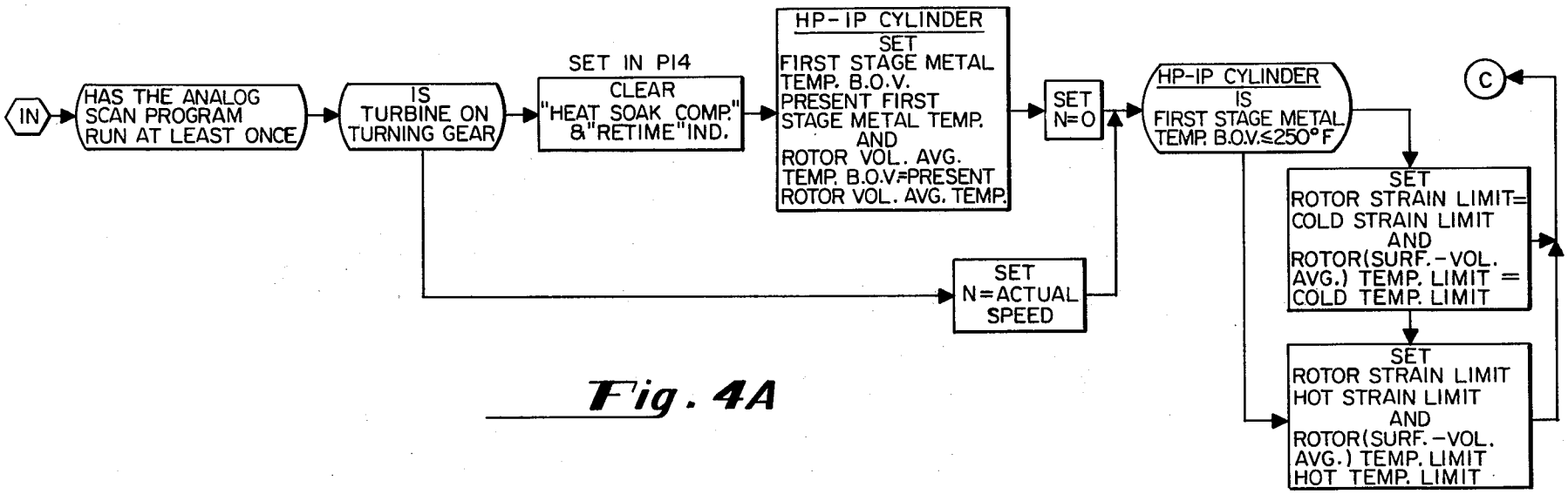
FIGS. 4A through 4D show detailed block diagrammatic representations of the rotor stress calculation program, P01, of the FIG. 2 block diagram. Again, those portions bearing particularly on the principles of the present invention are enclosed by a broken line in FIG. 4D.
Figure 4B:
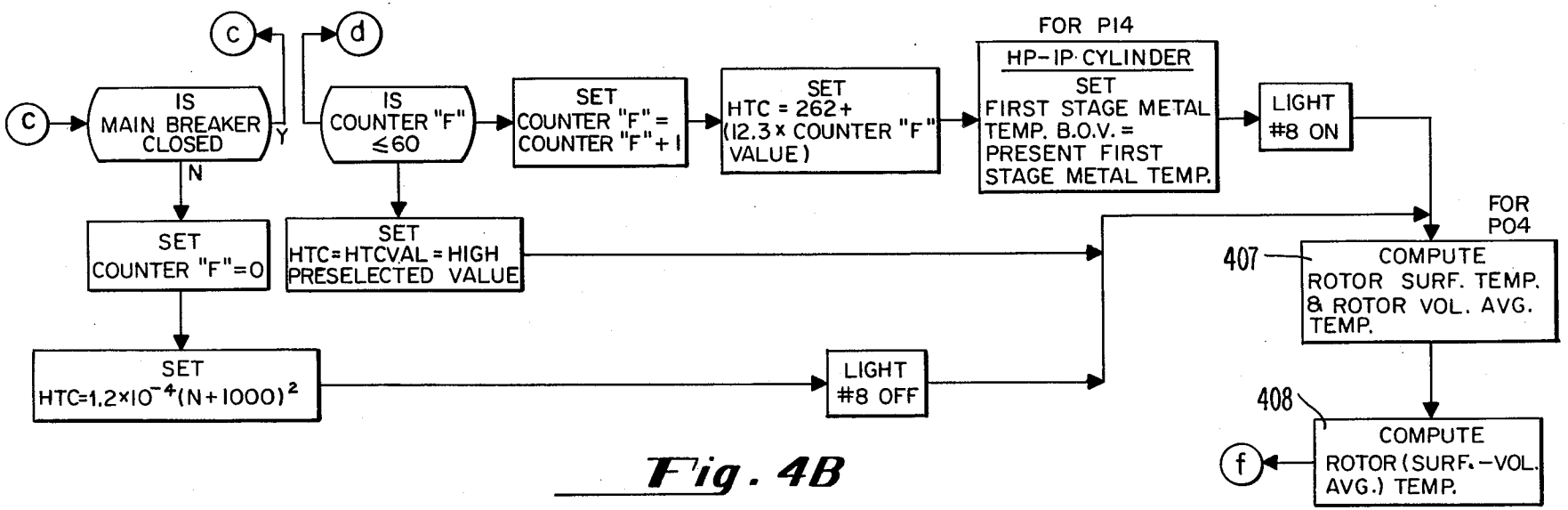
Figures 4C, 4D:
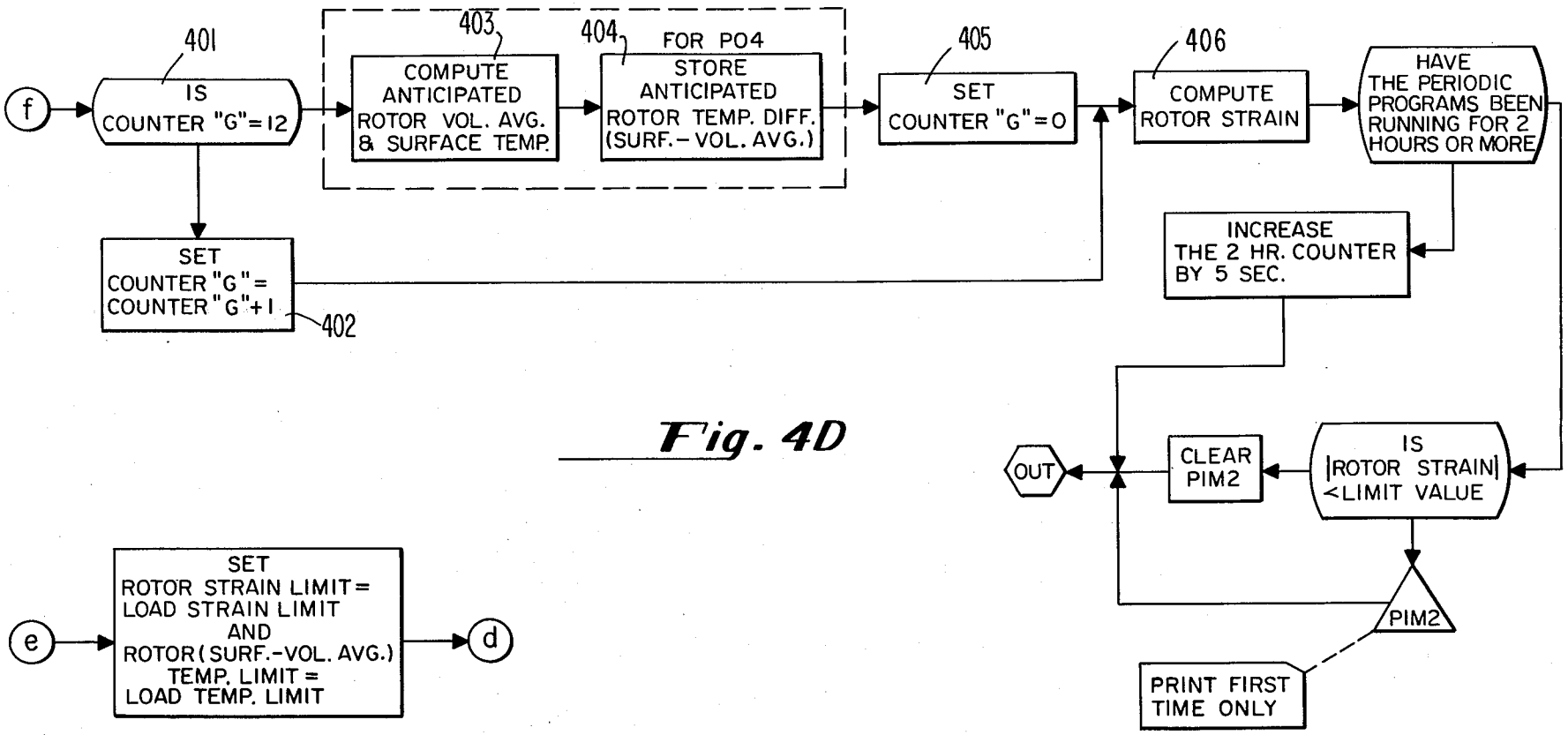

FIGS. 4A through 4D operating interactively at the continuation points "c" through "f" depict a block diagram of program P01 incorporating provisions for the principles of the present invention. The basic form of FIGS. 4A through 4D is that of program P01 of the referenced copending application. In FIG. 4D, the portions of the procedure which are altered in accordance with the principles of the present invention are enclosed with a broken line.

The general strategy of FIGS. 4A through 4D is that rotor strain may be evaluated as a direct function of the difference between the rotor surface temperature and the rotor volume average temperature. Program P01, as exemplified in the referenced co-pending application, calculates both rotor surface temperature and rotor volume average temperature as a function of an evaluated heat transfer coefficient HTC (the same one used initially in FIG. 3B). For each time of interest, present rotor surface temperature, present volume average temperature and present stress and strain is evaluated in P01. In accordance with the principles of the present invention as exemplified by FIGS. 4A through 4D, not only are the present surface and volume average rotor temperatures computed, but in accordance with anticipated speed in conjunction with a mathematical model, an anticipated heat transfer coefficient, and anticipated rotor volume average and surface temperatures are calculated and stored.

In FIGS. 4A through 4C, various strain and temperature limits are set, appropriate variables are initialized, and a present heat transfer coefficient HTC is evaluated in similar manner to the referenced co-pending application. The present rotor surface temperature and the present rotor volume average temperature, and the difference therebetween is computed. More specifically, as in the case of the foregoing differential expansion calculations, a preferred model of the rotor divides it into a predetermined number of layers concentric with the bore. Propagation of heat from one to the other is developed, and the volume average temperature is the average over all the layers. In accordance with the same scheme, the rotor surface temperature effectively may be considered to be the outer layer of such an incremental model. Thus, the absorption of heat by the outer layer of the rotor model is a function of the temperature, speed configuration and composition of the rotor and the heat transfer between steam and rotor. More specifically, it is a function of the volume of the outer layer as set forth in the model, and the specific heat of the metal. As set forth in closed form for statements 192 through 197 of the appended printout of program P01, the rotor surface temperature ROTSURF is equivalent to the outer layer temperature TP(l), which in its closed form in statement 190 is a function of constants C(i,j), developed from the volume of the layer and the specific heat of the metal, the heat transfer coefficient HTC, and the steam temperature TIMP. Subsequent increments from layer to layer are seen to provide the data for calculation of the rotor volume average temperature.

After the present rotor surface temperature, present rotor volume average temperature, and differential rotor (surface-volume average) temperature are evaluated at 407 and 408 of FIG. 4B, flow passes to FIG. 4D as indicated by the continuation "f". In accordance with the overall operating system depicted in FIG. 2, as well as in the referenced co-pending application, program P01 is scheduled to be executed every five seconds, to yield a computation of rotor strain at that rate, but the evaluation of the anticipated rotor temperature differential of the surface minus the volume average temperature for use in FIG. 4 need only be accomplished once per minute. The mechanism set to bypass the broken lined portion in FIG. 4D (which calculates anticipated rotor temperature differentials) is the designation of a counter "G" which is incremented at 402 once for each execution of program P01. Once per minute, or every 12th execution of P01, the decision at 401 indicates that counter "G" is equal to 12, and the anticipated rotor temperature differential is to be evaluated. Accordingly, once per minute the yes branch is followed from 401 to 403, where the anticipated rotor volume average temperature and the anticipated rotor surface temperature are computed. These computations of anticipated quantities are done basically in a manner similar to that accomplished hereinbefore relative to differential expansion. That is, the anticipated speed is developed as in FIG. 3C, and an anticipated heat transfer coefficient $PH_R$ is calculated. In turn, the anticipated heat transfer coefficient may be substituted into the models for calculating the rotor surface temperature and the rotor volume average temperature, thereby to yield values called for in FIG. 3, the anticipated rotor volume average temperature and the anticipated rotor surface temperature. At 404, the anticipated rotor temperature differential between the rotor surface and volume average temperatures is developed, and maintained in storage for execution of program P04. The procedure exits the broken line portion of FIG. 4D, the counter "G" is reset to zero, and the program continues as in the referenced co-pending application.

In the referenced co-pending application, as well as in the operating system of FIG. 2 which embodies the principles of the present invention, the program P04, in response to a plurality of stored rotor temperature differentials, evaluates stress conditions relative to a number of predetermined limit values. Actually, since stress is directly proportional to the rotor (surface-volume average) temperature, those values rather than evaluated stress may be compared with properly adjusted limit values.

Figure 5:
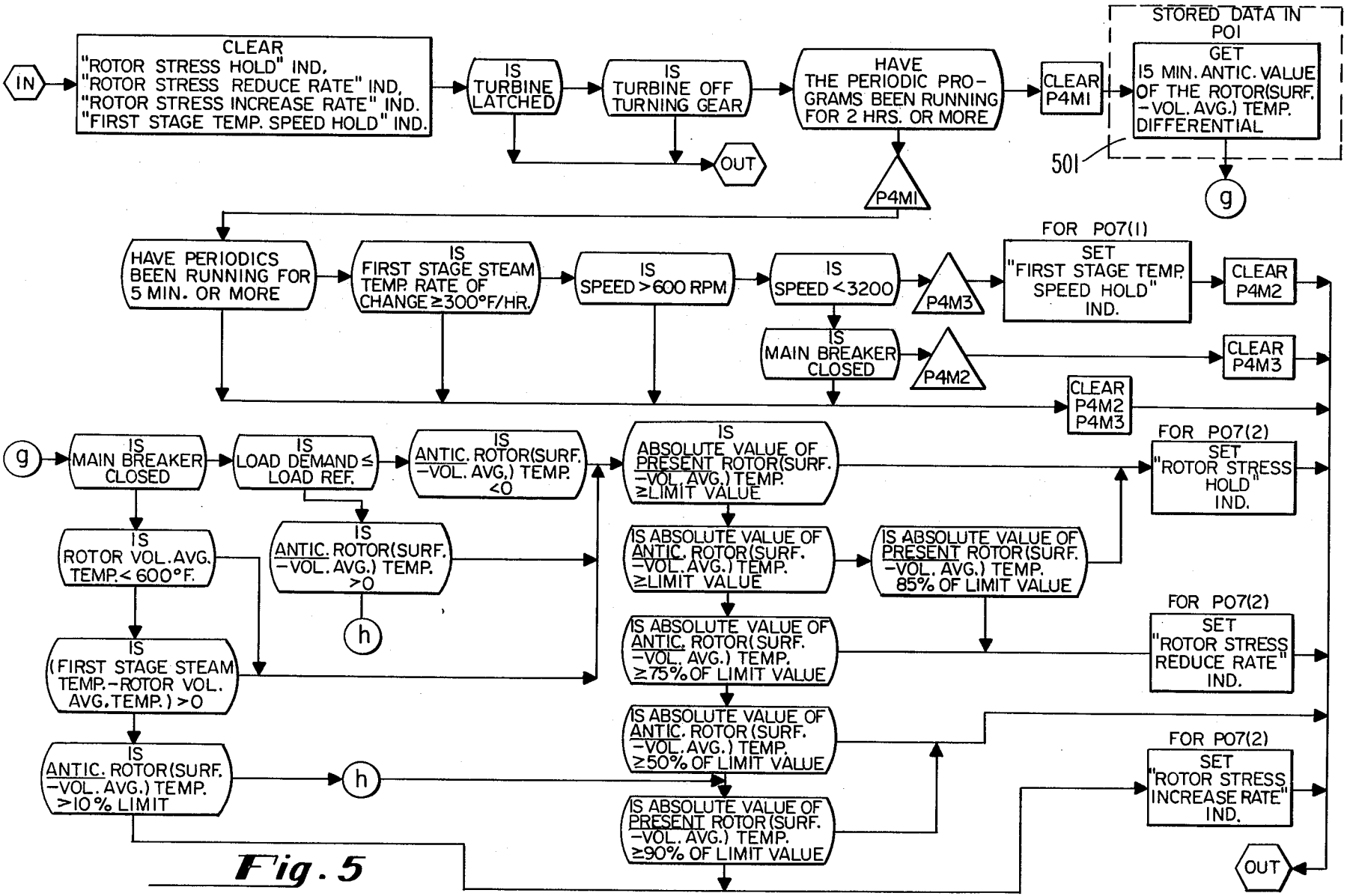
FIG. 5 shows a detailed block diagrammatic representation of the rotor stress control program, P04, of the FIG. 2 block diagram. Portions altered from the prior art in accordance with the principles of the present invention are once more enclosed by a broken line.

In the referenced co-pending application, the present rotor temperature differential and 14 previous values are extrapolated to yield an anticipated value, and the present and anticipated differentials are successively compared with a number of limiting values. This basic rationale is unchanged in the embodiment of FIG. 5 set forth in P04, except that, based on the different evaluation of anticipated rotor surface minus volume average temperature differential evaluated in P01, a much more accurate mode of stress control is realized. At 501, the anticipated value of rotor surface temperature minus rotor volume average temperature is called from storage. Then, as indicated by continuity factor "g", flow passes as in the referenced co-pending application for evaluation of the present and anticipated differentials variously against a limiting value, and percentages thereof. In turn, as was done in the referenced co-pending application and as is set forth in FIG. 2, program P04 exerts control over the speed selection of program P07 on the basis of "rotor stress hold", "rotor stress reduce rate", and "rotor stress increase rate" indicators. Also, a "first stage temperature speed hold" indicator may be set.

In summary, the foregoing embodiment of the principles of the present invention involve methods and apparatus for speed control based both on conditions of rotor stress and rotor to casing differential expansion. In both instances, speed and first stage steam temperature is utilized in conjunction with a predetermined mathematical model of the generator to develop anticipated rotor surface and rotor volume average temperatures, whereby anticipated differential expansion and anticipated stress and strain may be evaluated and utilized for speed control.

Figure 7:
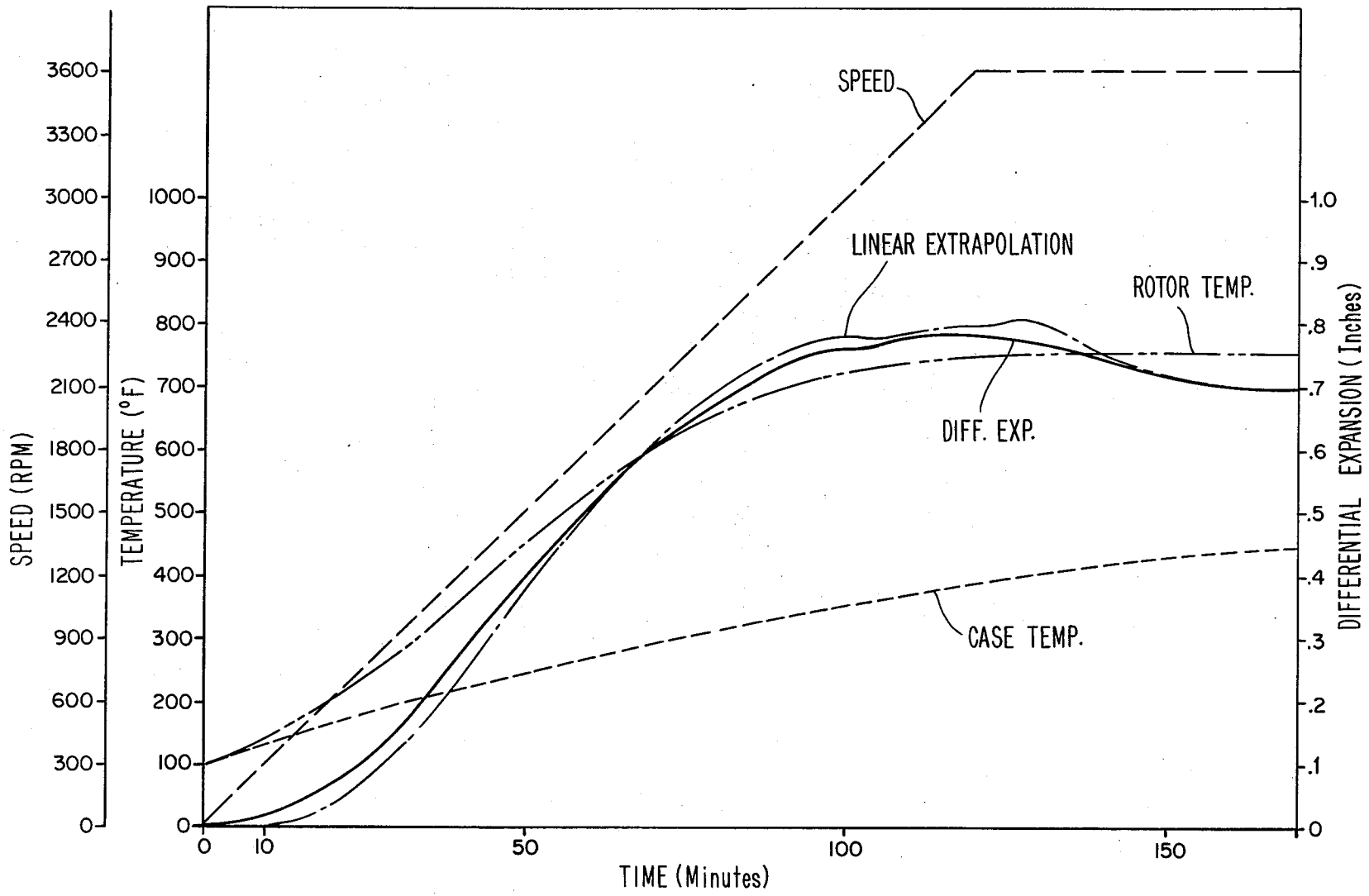
FIG. 7 depicts a graph plotting speed, temperature, time, and differential expansion for control system embodying the principles of the present invention, as compared with the linear extrapolation methods known in the prior art.

FIG. 7 shows a plot of speed, temperature, and differential expansion plotted against time both for the linear extrapolation methods of the referenced co-pending application and for the differential expansion mode of control featured in accordance with the principles of the present invention. In both cases, as speed increases to the loaded speed of 3600 RPM, the rotor temperature and casing temperature increase at different rates to yield a differential expansion. As is clearly shown in FIG. 7, the anticipative version of control in accordance with the principles of the present invention yields less differential expansion in the crucial high expansion portion of the curve. More particularly, the anticipative mode in accordance with the principles of the present invention provides improvement in precisely the range where damage might be done utilizing prior art linear extrapolation schemes.

The foregoing has been intended to be illustrative of the principles of the present invention. In both the apparatus and method aspects, it is seen that new algorithms provide advantageous operation in their own right, but further yield an entirely new and superior control loop. It is to be understood that numerous alternative embodiments, both in terms of method and apparatus, will readily occur to those skilled in the art without departure from the spirit or scope of the principles of the present invention.

What is claimed is:

1. Apparatus for controlling an electric power generating system, said system including a steam turbine adapted to drive an electric generator, comprising:

(a) means for sensing present values of a select plurality of operating parameters of said turbine;

(b) means, responsive to said present values, for characterizing present heat transfer conditions between the steam and said turbine;

(c) means, responsive to said conditions and to estimates of said select plurality of parameters at at least one predetermined future time, for predicting heat transfer conditions between the steam and said turbine at said future time; and (d) means for presently controlling the speed and acceleration of said turbine as a function of predicted future heat transfer conditions.

2. Apparatus as set forth in claim 1 wherein said means for characterizing and said means for predicting respectively include means for evaluating present turbine rotor to casing differential expansion, and means for evaluating anticipated rotor to casing differential expansion at said future times.

3. Apparatus as described in claim 2 wherein said means for characterizing further includes: means responsive to the present turbine speed, and to the present turbine first stage steam temperature, for evaluating the present steam to rotor and steam to casing heat transfer coefficients; and means, responsive to said present heat transfer coefficients, for evaluating the present heat propagation characteristics of said rotor and of said casing; said means for evaluating said present rotor to casing differential expansion operating in response to said last named means for evaluating.

4. Apparatus as described in claim 2 wherein said means for predicting further includes: means responsive to the estimated future turbine speed, and to the estimated future turbine first stage steam temperature for evaluating the estimated future steam to rotor and steam to casing heat transfer coefficients; and means, responsive to said estimated future heat transfer coefficients, for evaluating the estimated future heat propagation characteristics of said rotor and of said casing; said means for evaluating said estimated future rotor to casing differential expansion operating in response to said last named means for evaluating.

5. Apparatus as described in claim 2 wherein said means for characterizing operates in conjunction with a predetermined mathematical model of said turbine, and further comprises means for measuring actual present rotor to casing differential expansion; means for comparing evaluated present differential expansion with measured present differential expansion; and means for correcting said mathematical model in response to said means for comparing; and wherein said means for predicting operates in conjunction with the corrected version of said mathematical model.

6. Apparatus as described in claim 1 wherein said means for characterizing and said means for predicting respectively include means for evaluating present rotor stress and means for evaluating anticipated rotor stress at said future time.

7. Apparatus as described in claim 6 wherein said means for characterizing further includes: means, responsive to the present turbine speed and the present turbine first stage steam temperature, for evaluating the present steam to rotor heat transfer coefficient, said means for evaluating present rotor stress operating responsively to said means for evaluating the present heat transfer coefficient.

8. Apparatus as described in claim 7 wherein said means predicting further includes: means, responsive to the estimated future turbine speed and the estimated future turbine first stage temperature, for evaluating the estimated future steam to rotor heat transfer coefficient, said means for evaluating estimated future rotor stress operating responsively to said means for evaluating the estimated future heat transfer coefficient.

9. Apparatus as described in claim 1 wherein said means for predicting comprises means for predicting respective heat transfer conditions at a plurality of future times, means for developing representations of stress at each of said times, and means for comparing each representation with a maximum allowable stress, and wherein said means for controlling includes means for adjusting acceleration in response to said means for comparing.

10. A steam turbine system, comprising:

(a) a steam turbine;

(b) means for sensing the present value of at least one operating parameter of said turbine;

(c) means for estimating the values of said operating parameters at a predetermined future time;

(d) means, responsive to said means for estimating, for developing anticipated values of a predetermined function representative of turbine rotor stress at said future time; and (e) means for controlling the operation of said system by exerting present speed and acceleration control over said turbine as a predetermined function of the anticipated rotor stress representations.

11. A system as described in claim 10 wherein said turbine parameters include first stage steam temperature and rotor speed.

12. A system as described in claim 11 wherein said means for estimating provides representations of extrapolated first stage steam temperature, which representations are operated upon by said means for developing anticipated values.

13. A system as described in claim 12 wherein said means for controlling compares the anticipated rotor stress representations with a predetermined limit, and adjusts a target speed of said turbine as a function of said comparisons.

14. A system as described in claim 13 wherein said means for controlling comprises means for accelerating said turbine to a predetermined target speed in accordance with a predetermined speed profile.

15. A system as described in claim 12 and further including means, responsive to said means for estimating, for determining anticipated values of a predetermined function representative of turbine differential expansion, said means for controlling exerting further speed and acceleration control as a predetermined function of anticipated differential expansion representations.

16. A system as described in claim 15 wherein said means for determining anticipated differential expansion representations comprises:

(a) means for computing present differential expansion in accordance with a predetermined mathematical model of said turbine;

(b) means for measuring actual present differential expansion of said turbine;

(c) means for comparing computed and measured present differential expansion values;

(d) means, responsive to said means for comparing, for adjusting said mathematical model; and (e) means for computing anticipated differential expansion in accordance with the adjusted mathematical model.

17. A system as described in claim 16 wherein said mathematical model, as predetermined and as adjusted, represents a select, predetermined portion of said turbine.

18. A system as described in claim 15 wherein said turbine is adapted to receive steam from a steam generator means through valve means, the setting of said valve means at least partially affecting turbine speed and turbine thermal operating conditions, and wherein said means for controlling exerts speed and acceleration control by operating said valve means.

19. A steam turbine system for providing power to an electric generating system comprising:

(a) a steam turbine adapted to receive steam and to drive an electric generator;

(b) means for digitally computing and processing, having a central processor unit and a memory interconnected with said central processing unit;

(c) means for converting input signals to digital data, said input converting means connected to said digital computing means;

(d) means for converting digital data to output signals, said digital to output converting means connected to said digital computing means;

(e) means for sensing the value of predetermined turbine operating parameters and for generating input signals representative of said parameters, said sensing means being connected to said input converting means;

(f) means for controlling the steam flow to said turbine;

(g) means for connecting said output signal converting means to said steam flow control means;

(h) said digital computer means further including (i) means for computing anticipated values of at least one predetermined turbine operating parameter, (ii) means for computing anticipated values of a predetermined function representative of transfer of heat from steam to respective points of said turbine, and propagation of heat within said parts as a function of said at least one anticipated turbine operating condition; and (i) said control signals being converted to output signals by said output converting means for controlling said steam control means as a function of said determined anticipated values so as to control steam flow as an intermediate variable, and to control turbine speed during startup and turbine load during load operation as end operating variables.

20. The steam turbine system as described in claim 19, wherein said digital computer means further includes:

(a) means for accelerating said turbine from a given turbine speed to a given turbine target speed;

(b) means for adjusting said given turbine speed as a function of said determined anticipated value; and (c) means for adjusting the speed profile between the present turbine speed and said adjusted given turbine speed as a function of said determined anticipated values.

21. A steam turbine system as described in claim 19, and further including means for measuring turbine rotor to casing differential expansion, wherein said digital computer means includes means for developing a representation of present differential expansion in accordance with a predetermined mathematical model of said turbine, means for comparing computed and measured present differential expansion, and for adjusting said model in response thereto, and wherein said means for computing anticipated values develops anticipated differential expansion in accordance with the adjusted model.

22. A steam turbine system as described in claim 21, wherein said means for developing a representation includes means for evaluating a present steam to turbine heat transfer coefficient, present thermal propagation constants in respective parts of said turbine, and present differential expansion as a function of said coefficient, said constants, present rotor speed, and present steam temperatures.

23. A system as described in claim 22 wherein said means for developing a representation further includes means for evaluating present rotor stress as a function of said coefficient, present rotor speed, present steam temperatures, and the thermal properties of the turbine rotor.

24. A system as described in claim 21 wherein said means for computing anticipated values includes means for estimating turbine speed and steam temperatures at a given future time, means for developing an anticipated steam to turbine heat transfer coefficient and anticipated thermal propagation constants at said future time, and means for developing anticipated differential expansion at said future time as a function of said estimated and anticipated quantities.

25. A system as described in claim 24 wherein said means for computing anticipated values further includes means for developing anticipated rotor stress at said future time in response to said estimated and anticipated quantities.

26. A method for controlling an electric power generating system, said system including a steam turbine adapted to drive an electric generator, comprising:

(a) sensing present values of a select plurality of operating parameters of said turbine;

(b) characterizing, in response to said present values, present heat transfer conditions between the steam and respective parts of said turbine;

(c) predicting, in response to said present values, said present conditions, and estimated values of said parameters at at least one predetermined future time, anticipated heat transfer conditions between the steam and said respective parts at said predetermined future time; and (d) controlling the present speed and acceleration of said turbine as a function of predicted heat transfer conditions at said future time.

27. A method as described in claim 26 wherein said characterizing step includes evaluating present turbine rotor to casing differential expansion, and wherein said predicting step includes evaluating anticipated differential expansion at said future time.

28. A method as described in claim 27 wherein said characterizing step further includes evaluating, in response to the present turbine speed and the present first stage steam temperature, the present steam to rotor heat transfer coefficients; and further for evaluating, responsive to said present coefficients, the present heat propagation characteristics of the turbine rotor and of the turbine casing; and wherein said step of evaluating present rotor to casing expansion is in response to said present coefficients and characteristics.

29. A method as described in claim 27, wherein said predicting step includes: evaluating, in response to the estimated future turbine speed and the estimated future first stage steam temperature, the estimated future steam to rotor heat transfer coefficients; and further for evaluating, responsive to said estimated future coefficients, the estimated future heat propagation characteristics of the turbine rotor and of the turbine casing; and wherein said step of evaluating estimated future rotor to casing expansion is in response to said estimated future coefficients and characteristics.

30. A method as described in claim 27, wherein said characterization step includes exercising a predetermined mathematical model of said turbine to evaluate present differential expansion, measuring actual present differential expansion of said turbine, comparing evaluated with measured present differential expansion, and adjusting said model in response to the comparison, said predicting step including exercising the adjusted model to evaluate future differential expansion.

31. A method as described in claim 26 wherein said characterizing step includes evaluating present rotor stress, and said predicting step includes evaluating anticipated rotor stress at a predetermined future time.

32. A method as described in claim 31 wherein said characterizing step further includes evaluating, in response to present steam temperature and rotor speed, a present steam to rotor heat transfer coefficient, said step of evaluating present rotor stress operating responsively to said coefficient.

33. A method as described in claim 31 wherein said predicting step further includes: evaluating, in response to estimated future steam temperature and rotor speed, an estimated future steam to rotor heat transfer coefficient, said step of evaluating estimated future rotor stress operating responsively to said coefficient.

34. A method as described in claim 26 wherein said predicting step includes predicting respective heat transfer conditions at a plurality of future times, developing representations at each of said times, and comparing each representation with a maximum allowable stress, and wherein said controlling step includes adjusting acceleration in response to said comparing steps.

35. A method of operating a steam powered electrical generating system comprising the steps of:

(a) providing a steam turbine;
(b) sensing the present value of at least one operating parameter of said turbine;
(c) estimating the values of said parameters at a predetermined future time;
(d) developing, in response to estimated parameters, anticipated values of a predetermined function representative of turbine rotor stress at said future time; and
(e) controlling the operation of said system by exerting present speed and acceleration control over said turbine as a predetermined function of the anticipated rotor stress representations.

36. A method as described in claim 35 wherein said turbine parameters include first stage steam temperature and rotor speed.

37. A method as described in claim 36 wherein said estimating step includes providing representations of extrapolated first steam temperature, which representations are utilized in said developing step.

38. A method as described in claim 37 wherein said controlling step includes comparing the anticipated rotor stress representations with a predetermined limit, and adjusting a target speed of said turbine as a function of said comparisons.

39. A method as described in claim 38 wherein said controlling step further includes accelerating said turbine to a predetermined target speed in accordance with a predetermined speed profile.

40. A method as described in claim 37 and further including the step of determining, in response to said estimating step, anticipated values of a predetermined function representative of turbine differential expansion, said controlling step exerting further speed and acceleration control as a predetermined function of anticipated differential expansion representations.

41. A method as described in claim 40 wherein said step of determining anticipated differential expansion representations comprises:

(a) computing present differential expansion in accordance with a predetermined mathematical model of said turbine;
(b) measuring actual present differential expansion of said turbine;
(c) comparing computed and measured present differential expansion values;
(d) adjusting said model in response to said comparing step; and
(e) computing anticipated differential expansion in accordance with the adjusted mathematical model.

42. A method as described in claim 41 wherein said mathematical model, as predetermined and as adjusted, represents a select predetermined portion of said turbine.

43. A method of providing power to an electric generating system comprising the steps of:

(a) providing a steam turbine adapted to receive steam and to drive an electric generator;
(b) providing a digital processor having a central processor with an interconnected memory;
(c) monitoring a select plurality of operating parameters of said turbine, converting the parameters as digital representations thereof, and coupling the representations to said processor;
(d) periodically computing anticipated values of said parameters for a given future time;
(e) periodically computing anticipated values of a predetermined function representative of transfer of heat from steam to respective parts of said turbine, and propagation of heat within said parts as a function of said anticipated parameters;
(f) developing digital control signals by comparing anticipated values of said function with predetermined limits;
(g) coupling said digital control signals to operate steam flow control means for said turbine, said control of steam flow functioning as an intermediate variable to control turbine speed and acceleration during turbine startup and load conditions.

44. A method as described in claim 43, wherein said step of developing digital control signals includes the steps of:

(a) accelerating said turbine from a given speed to a given target speed;
(b) adjusting said given speed as a function of said determined anticipated heat transfer conditions; and
(c) adjusting the speed profile between the present turbine speed and the adjusted given speed as a function of said anticipated heat transfer conditions.

45. A method as described in claim 43 and further including the steps of:

(a) measuring present turbine to casing differential expansion;
(b) developing, in said step of developing digital control signals, a representation of present differential expansion in accordance with a predetermined mathematical model of said turbine;
(c) comparing the measured and computed values of present differential expansion; and
(d) adjusting said model in response to said comparing step;
(e) said digital control signals being developed in accordance with the adjusted mathematical model.

46. A method as described in claim 45, wherein said step of developing a representation of present differential expansion includes evaluating a present steam to turbine heat transfer coefficient, present thermal propagation constants in respective parts of said turbine, and present differential expansion as a function of said constants, said coefficient, present rotor speed and present steam temperatures.

47. A method as described in claim 46 wherein said step of developing a representation of present differential expansion further includes evaluating present rotor stress as a function of said coefficient, present rotor speed, present steam temperatures, and the thermal properties of the rotor.

48. A method as described in claim 45 wherein said step of computing anticipated values includes estimating turbine speed at a given future time, developing an anticipated steam to turbine heat transfer coefficient and anticipated thermal propagation constants for said future time, and developing anticipated differential expansion at said future time as a function of said estimated and anticipated quantities.

49. A method as described in claim 48 wherein said step of computing anticipated values further includes developing a representation of anticipated rotor stress at said future time in response to said anticipated and estimated quantities.

* * * * *